United States Patent [19]

Allen

[11] Patent Number: 4,583,732

[45] Date of Patent: Apr. 22, 1986

[54] BREAKAWAY BASKETBALL GOAL

[75] Inventor: David A. Allen, New Berlin, Wis.

[73] Assignee: Huffy Corporation, Miamisburg, Ohio

[21] Appl. No.: 709,048

[22] Filed: Mar. 7, 1985

[51] Int. Cl.[4] ..... A63B 63/08

[52] U.S. Cl. ..... 273/1.5 R

[58] Field of Search ..... 273/1.5 R

[56] References Cited

U.S. PATENT DOCUMENTS

| | | | |
|---|---|---|---|
| 3,820,784 | 6/1974 | Boitano et al. | 273/1.5 R |
| 4,111,420 | 9/1978 | Tyner | 273/1.5 R |
| 4,348,022 | 9/1982 | O'Donnell | 273/1.5 R |
| 4,433,839 | 2/1984 | Simonseth | 273/1.5 R |
| 4,438,923 | 3/1984 | Engle et al. | 273/1.5 R |
| 4,441,709 | 4/1984 | Schroeder et al. | 273/1.5 R |

FOREIGN PATENT DOCUMENTS

| | | | |
|---|---|---|---|
| 10831 | of 1892 | United Kingdom | 49/383 |

*Primary Examiner*—Paul E. Shapiro

*Attorney, Agent, or Firm*—Andrus, Sceales, Starke & Sawall

[57] ABSTRACT

A rim mounting plate (26) is mounted to a backboard mounting plate (12) by a resiliently biased release mechanism (16) including an adjustable control (20) and compression spring (18) for varying the breakaway release force and for automatically returning the rim to horizontal after a slam dunk. The rim has a pair of supports (46 and 48) extending downwardly from opposite undersides thereof and joined at a central portion (34) forming the pivot point adjacent the backboard. The backboard mounting plate has a lower portion (52) curled around the central portion of the supports and coined to provide a snug interference fit substantially eliminating vertical and horizontal free play at the pivot point. A protective pinch gap and includes a portion extending vertically downwardly between the backboard and the backboard mounting plate to dampen oil canning against the backboard shroud (58) covers the mounting plates and the gap therebetween when the rim is in its downward pivoted position, to prevent a player from pinching his fingers in the gap.

6 Claims, 5 Drawing Figures

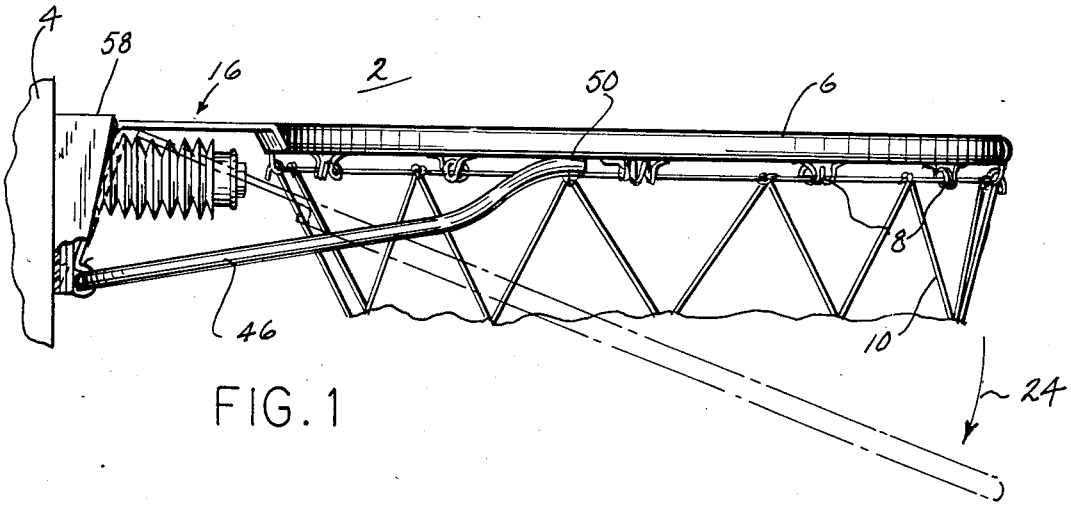
FIG. 1
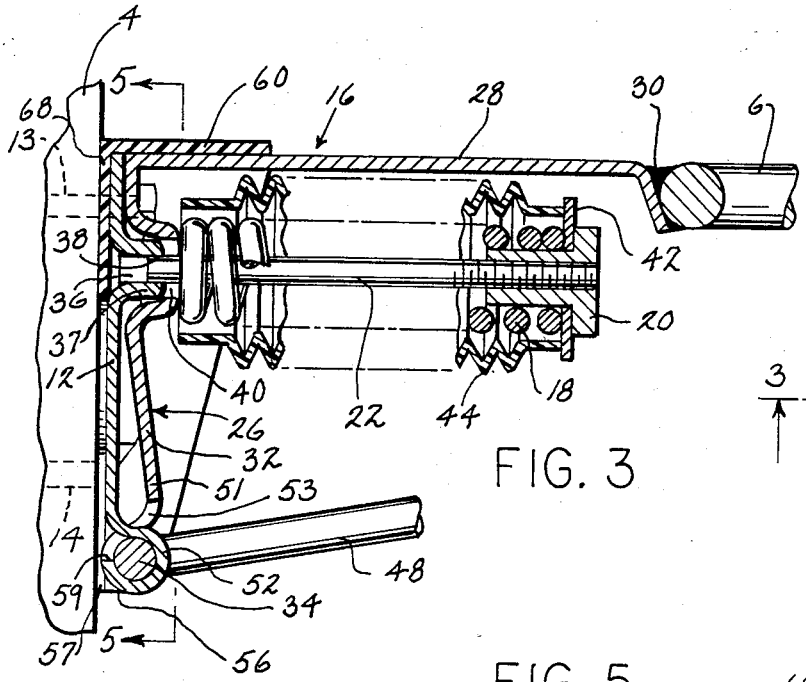
FIG. 3
FIG. 2
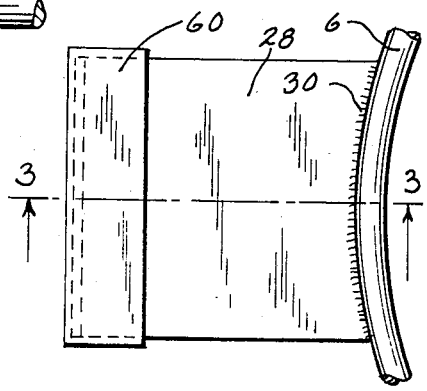
FIG. 5
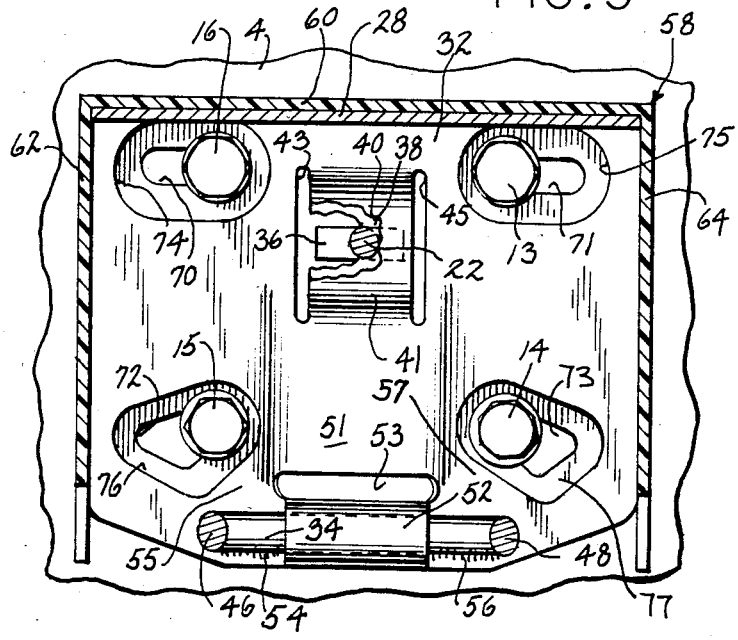
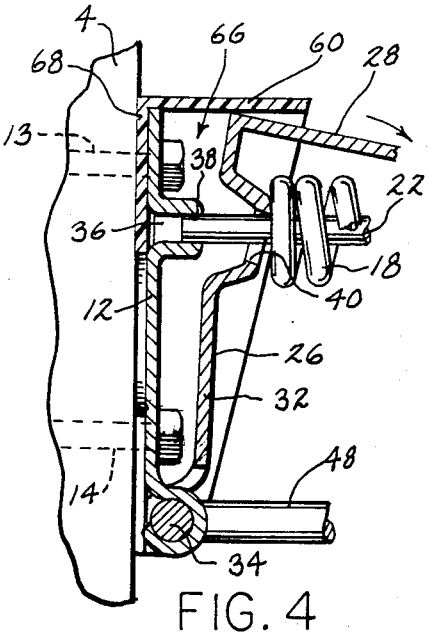
FIG. 4

BREAKAWAY BASKETBALL GOAL

BACKGROUND AND SUMMARY

The invention relates to a basketball goal assembly which will give or breakaway in response to a given threshold force on the rim such as a slam dunk.

A need has arisen for a breakaway basketball goal in order to protect the player by absorbing energy in order to reduce wrist, hand and arm injuries. There is a further need to protect the backboard to which the rim is mounted from breaking or shattering, especially in the case of fiberglass backboards.

In one type of known breakaway basketball goal, a pivot point is provided at the back edge of the rim assembly in the horizontal plane of the rim. A rocker arm assembly extends downwardly and rearwardly into a hydraulic cylinder or shock absorber at an angle which permits downward pivoting of the rim in response to a certain force collapsing or retracting the cylinder or shock absorber.

In another type of breakaway goal, a hinge point is provided with a fastener, and a sheer pin which breaks when the goal is overloaded, after which a new sheer pin is inserted in order to resume play.

The present invention provides a simple and effective breakaway basketball goal with releasable mounting structure. The rim is automatically returned, without manual intervention, upon removal of the overload force. User adjustable control means varies the threshold overload force for breakaway. A protective pinch gap shroud is provided covering a gap between mounting plates when the rim is released, to prevent a player from pinching his fingers in such gap. The shroud also extends between the mounting plate and the backboard to dampen oil canning. The mounting plate has a universal aperture mounting configuration.

BRIEF DESCRIPTION OF THE DRAWINGS

FIG. 1 shows a breakaway basketball goal assembly constructed in accordance with the invention.

FIG. 2 is a top view of a portion of the structure in FIG. 1.

FIG. 3 is a sectional view taken along line 3—3 of FIG. 2.

FIG. 4 is a view like FIG. 3 but showing the assembly in a released position.

FIG. 5 is a sectional view taken along line 5—5 of FIG. 3.

DETAILED DESCRIPTION

There is shown in FIG. 1 an automatic return slam dunk breakaway basketball goal assembly 2 for mounting to a backboard 4. The assembly includes a basketball goal rim 6 having a plurality of rams 8 for holding net 10. Mounting plate means 12, FIG. 3, is mounted to backboard 4 by a plurality of bolts such as 13–16, FIG. 5. Means 16 is provided for releasably mounting rim 6 to mounting plate 12 and releasing the rim for movement from a first to a second position to absorb force on the rim greater than a given threshold, and automatically returning the rim to the first position without manual intervention upon removal of the force. Resilient biasing means is provided by compression spring 18 biasing rim 6 to its first position. User adjustable control means is provided by nut 20 on threaded stud 22 for varying the bias of biasing means 18 for changing the noted given threshold force.

As seen in FIGS. 1, 3 and 4, means 16 pivotally mounts rim 6 to mounting plate 12. Rim 6 has a first horizontal position, as shown in solid line in FIG. 1, and has a second downwardly pivoted position, as shown in dashed line in FIG. 1 at arrow 24, responsive to a slam dunk or other overload downward force on the rim. Biasing means 18 biases rim 6 to the horizontal position and yields in response to the given threshold downward force on the rim to permit pivoting of the rim to the downward position.

Pivotal mounting means 16 includes a second mounting plate 26 rigidly mounted to rim 6 and pivotally mounted to first mounting plate 12. Second mounting plate 26 is an inverted generally L-shaped member having a horizontal leg 28 secured to rim 6 at weldment 30, and having a generally vertical leg 32 pivotally mounted at its lower end to the lower end of first vertical mounting plate 12 at pivot point 34. Biasing means 18 is operatively coupled to the first and second mounting plates 12 and 26 to bias such plates in a given direction relative to each other.

As seen in FIG. 4, second mounting plate 26 pivots rightwardly and downwardly away from mounting plate 12 at pivot point 34. Pivot point 34 is below the horizontal plane of rim 6. Spring 18 extends in a generally horizontal plane below the plane of rim 6 and above pivot point 34. The biasing means includes horizontal stud 22 having its left end formed with a T-shape or cross bar 36 retained on the left side of a rightwardly raised boss 37 formed in vertical mounting plate 12. Stud 22 extends righwardly from head 36 through an aperture 38 formed in raised boss 37. The stud is trapped in the raised boss but does have some free play therein to allow pivoting of stud 22 slightly downwardly as mounting plate 26 and rim 6 pivot downwardly. Besides passing through aperture 38 in raised boss 37, stud 22 also extends rightwardly through an aperture 40 in a rightwardly raised boss 41 of vertical leg 32 of mounting plate 26. Aperture 40 is wider, i.e, greater vertical extent as seen in FIG. 3, than aperture 38 to enable the noted up-down pivoting of stud 22 therein. Vertical slots, such as shown at 43 and 45, FIG. 5, are formed in the mounting plates to facilitate formation of bosses 37 and 41.

Compression spring 18 encircles stud 22. The left end of compression spring 18 bears against boss 41. The right end of stud 22 is threaded and receives nut 20 and retaining washer 42. The right end of compression spring 18 bears against washer 42. A plastic bellows 44 is provided around spring 18 between retainer 42 and vertical leg 32 to provide a flexible expansible cover for the spring and to protect the players. Pivoting of vertical leg 32 of support plate 26 away from vertical support plate 12 at pivot point 34 compresses spring 18 when the downward force on rim 6 is greater than a given threshold or overload. Turning nut 20 clockwise or inwardly compresses spring 18 and increases the amount of force on rim 6 necessary to cause release and breakaway for pivoting to the downward dashed line position in FIG. 1. Conversely, turning nut 20 outwardly or counterclockwise reduces the amount of threshold force necessary for release and breakaway. This mechanism thus provides user adjustable control means for varying the bias of spring 18 for changing the given threshold.

Rim 6 has a pair of supports 46 and 48, FIGS. 1 and 5, extending downwardly from opposite undersides of the rim, at weldments such as 50, and joined at a central portion 34 forming the noted pivot point adjacent backboard 4. Vertical mounting plate 12 includes means 52 engaging and pivotally mounting central portion 34 of the supports. Vertical leg 32 of second support plate 26 is rigidly secured to the central portion 34 of supports 46 and 48 at weldments 54 and 56. Portion 52 of vertical mounting plate 12 is curled around central portion 34 of the supports and coined to provide a snug interference type fit substantially eliminating vertical and horizontal free play at pivot point 34. Vertical leg 32 of the pivoted mounting plate extends downwardly and slightly rightwardly at 51 away from plate 12 and has a central aperture 53 therethrough, FIGS. 3 and 5. The portions 55 and 57 on opposite sides of central portion 51 and slot 53 of vertical leg 32 extend substantially straight downwardly behind, as viewed in FIG. 5, central portion 34 of supports 46 and 48, which is left of central portion 34 in FIG. 3, and are attached thereto at the noted weldments 54 and 56. Portion 52 of mounting plate 12 extends forwardly, FIG. 5, through aperture 53, which is rightwardly through aperture 53 in FIG. 3, and then curls around central portion 34 downwardly and rearwardly and again slightly upwardly at end segement 59 of curled portion 52. Aperture 53 continues downwardly through the bottom of vertical leg 32 to accommodate curled portion 52 therein.

A protective pinch gap plastic shroud 58 has a top portion 60 and side portions 62 and 64 covering the top and sides of the first and second mounting plates 12 and 26 and the gap 66 therebetween, FIG. 4, when mounting plate 26 is pivoted away from mounting plate 12, to prevent a player from pinching his fingers in such gap. Shroud 58 also includes a rear portion 68 extending vertically between backboard 4 and mounting plate 12 to dampen oil canning against the backboard and minimize the noise caused thereby.

Mounting plate 12 has a plurality of apertures therethrough, some of which such as 70 and 71, FIG. 5, have an extended slot configuration, and others such as 72 and 73 have an extended slot configuration oblique to the first extended slots and which also may be triangular, to provide a universal mounting aperture configuration to fit many different backboards. Mounting plate 26 has counterpart slots 74–77 of comparable shape to slots 70–73 but of larger cross section to accommodate the heads of bolts 13–16 therethrough when plate 26 is in its first position against plate 12.

It is recognized that various modifications and alternatives are possible within the scope of the appended claims.

I claim:

1. A slam dunk breakaway basketball goal assembly for mounting to a backboard comprising:

a basketball goal rim;

mounting plate means for mounting to said backboard;

means pivotally mounting said rim to said mounting plate means, said rim having a first horizontal position and a second downwardly pivoted position responsive to a slam dunk or the like;

means biasing said rim to said horizontal position and yielding in response to a given threshold downward force on said rim to permit pivoting of said rim to said downward position, wherein:

said pivotal mounting means comprises second mounting plate means rigidly mounted to said rim and pivotally mounted to said first mounting plate means;

wherein said biasing means is operatively coupled to said first and second mounting plate means to bias them in a given direction relative to each other;

wherein said second mounting plate means pivots away from said first mounting plate means at a pivot point below the horizontal plane of said rim;

wherein said biasing means comprises spring means extending generally horizontally below said plane of said rim and above said pivot point;

wherein:

said first mounting plate means comprises a generally vertical plate for mounting to said backboard;

said second mounting plate means comprises a generally inverted L-shaped member having a generally vertical leg extending along said vertical plate in said first position and having a generally horizontal leg extending away from said vertical plate and having said rim mounted at the outer end of said horizontal leg;

said biasing means comprises a generally horizontal stud having one end retained by said vertical plate and encircled by a compression spring bearing between said vertical leg and a retainer on the other end of said stud, such that pivoting of said vertical leg away from said vertical plate at said pivot point below said spring compresses said spring when the downward force on said rim is greater than said given threshold;

wherein said rim has a pair of supports extending downwardly from opposite undersides thereof and joined at a central portion forming said pivot point adjacent said backboard, said vertical plate including means engaging and pivotally mounting said central portion of said supports, said vertical leg being rigidly secured to said central portion of said supports;

said last mentioned means of said vertical plate is curled around said central portion of said supports and coined to provide a snug fit substantially eliminating vertical and horizontal free play at said pivot point.

2. The invention according to claim 1 wherein said one end of said stud is mounted to said vertical plate with some free play to allow pivoting of said stud and said spring downwardly as said second mounting plate means and rim pivot downwardly.

3. A slam dunk breakaway basketball goal assembly for mounting to a backboard comprising:

a basketball goal rim;

mounting plate means for mounting to said backboard;

means pivotally mounting said rim to said mounting plate means, said rim having a first horizontal position and a second downwardly pivoted position responsive to a slam dunk or the like;

means biasing said rim to said horizontal position and yielding in response to a given threshold downward force on said rim to permit pivoting of said rim to said downward position, wherein:

said pivotal mounting means comprises second mounting plate means rigidly mounted to said rim and pivotally mounted to said first mounting plate means;

wherein said biasing means is operatively coupled to said first and second mounting plate means to bias them in a given direction relative to each other;

wherein said second mounting plate means pivots away from said first mounting plate means at a pivot point below the horizontal plane of said rim;

and comprising protective pinch gap shroud means covering at least a portion of said first and second mounting plate means and the gap therebetween when said second mounting plate means is in said second position pivoted away from said first mounting plate means, to prevent a player from pinching his fingers in said gap, wherein said shroud means is formed of plastic or like material and includes a portion extending vertically between said backboard and said first mounting plate means to dampen oil canning against said backboard.

4. A slam dunk breakaway basketball goal assembly for mounting a backboard comprising:

a basketball goal rim;

first mounting plate means comprising a generally vertical plate for mounting to said backboard;

a set of four apertures through said vertical plate spaced to form a rectangle, the first and second apertures having an extended slot configuration, the third and fourth apertures having a triangular configuration each with extension along at least one side of the triangle oblique to the extension of a respective one of said first and second extended slot apertures, said first aperture being diagonally opposite said third aperture in said rectangle, said second aperture being diagonally opposite said fourth aperture in said rectangle;

second mounting plate means comprising a generally inverted L-shaped member rigidly mounted to said rim and pivotally mounted to said first mounting plate means to pivot from a first horizontal rim position to a second downwardly pivoted position at a pivot point below the horizontal plane of said rim; and biasing means coupled between said first and second mounting plate means and biasing said rim to said horizontal position and yielding in response to a given threshold downward force on said rim to permit said pivoting of said rim to said downward position.

5. The invention according to claim 4 wherein:

said first and second apertures form a horizontal upper side of said rectangle;

the extensions of said slot configurations of said first and second apertures extend along a co-linear horizontal axis;

said third and fourth apertures form a horizontal lower side of said rectangle;

said oblique extensions of said one sides of said triangular configurations of said third and fourth apertures extend along oblique projections intersecting at the vertical center-line of said rectangle.

6. The invention according to claim 4 wherein said inverted L-shaped member of said second mounting plate means has a generally vertical leg extending along said vertical plate of said first mounting plate means, and comprising a second set of four apertures through said vertical leg of said L-shaped member of identical rectangular configuration as said first rectangle, wherein:

each of the first, second, third and fourth apertures of said second set is of identical shape to respective said first, second, third and fourth apertures of said first set but of larger area;

said first, second, third and fourth apertures of said second set exactly symmetrically overlie respective said first, second, third and fourth apertures of said first set when said rim is horizontal.

* * * * *

UNITED STATES PATENT AND TRADEMARK OFFICE

CERTIFICATE OF CORRECTION

PATENT NO. : 4,583,732

DATED : April 22, 1986

INVENTOR(S) : DAVID A. ALLEN

It is certified that error appears in the above-identified patent and that said Letters Patent is hereby corrected as shown below:

In the Abstract, lines 14-21, after "point." delete "A protective pinch gap . . ." to the end of the paragraph and insert:

--A protective pinch gap shroud (58) covers the mounting plates and the gap therebetween when the rim is in its downward pivoted position, to prevent a player from pinching his fingers in the gap, and includes a portion extending vertically downwardly between the backboard and the backboard mounting plate to dampen oil canning against the backboard.--

Signed and Sealed this

Twenty-first Day of October, 1986

[SEAL]

*Attest:*

DONALD J. QUIGG

*Attesting Officer* *Commissioner of Patents and Trademarks*